US005431142A

United States Patent [19]

Bonse

[11] Patent Number: 5,431,142

[45] Date of Patent: Jul. 11, 1995

[54] FUEL INJECTION SYSTEM FOR INTERNAL COMBUSTION ENGINES

[75] Inventor: Bernhard Bonse, Stuttgart, Germany

[73] Assignee: Robert Bosch GmbH, Stuttgart, Germany

[21] Appl. No.: 198,701

[22] Filed: Feb. 18, 1994

[30] Foreign Application Priority Data

Feb. 18, 1993 [DE] Germany ..... 43 04 967.2

[51] Int. Cl.[6] ..... F02M 59/36; F02M 63/02; F02M 41/16

[52] U.S. Cl. ..... 123/450; 123/506

[58] Field of Search ..... 123/447, 450, 449, 500, 123/503, 506, 387

[56] References Cited

U.S. PATENT DOCUMENTS

| | | | |
|---|---|---|---|
| 2,391,221 | 12/1945 | Beeh . | |
| 4,573,442 | 3/1986 | Matsummura et al. | 123/450 |
| 4,625,694 | 12/1986 | Adey et al. | 123/450 |
| 4,652,220 | 3/1987 | Mowbray | 123/450 |
| 4,660,522 | 4/1987 | Babitzka | 123/450 |
| 4,767,288 | 8/1988 | Straubel | 123/450 |
| 4,940,037 | 7/1990 | Eckert | 123/447 |
| 4,964,389 | 10/1990 | Eckert | 123/447 |
| 4,976,236 | 12/1990 | Brunel | 123/447 |
| 5,027,776 | 7/1991 | Nicol | 123/450 |
| 5,245,971 | 9/1993 | Rembold et al. | 123/450 |
| 5,318,001 | 6/1994 | Djordjevic | 123/506 |
| 5,327,869 | 7/1994 | Rembold et al. | 123/502 |
| 5,345,916 | 9/1994 | Amann et al. | 123/450 |

FOREIGN PATENT DOCUMENTS

| | | |
|---|---|---|
| 0381954 | 1/1990 | European Pat. Off. . |
| 0472404 | 5/1991 | European Pat. Off. . |
| 103591 | 4/1973 | Germany . |

*Primary Examiner*—Thomas Moulis

*Attorney, Agent, or Firm*—Edwin E. Greigg; Ronald E. Greigg

[57] ABSTRACT

A fuel injection system for internal combustion engines in which a high-pressure pump and a high-pressure reservoir is supplied with fuel at an injection pressure, from which reservoir the fuel arriving at injection is diverted as a function of time and quantity and delivered via a distributor to one of a plurality of injection points, via two sequentially electrically controlled valves. The injection points are triggered successively by a distributor opening of the distributor. With a fuel pressure, thus held at a certain pressure, in the high-pressure reservoir, a universally controllable fuel injection system is attained in a simple way, at little effort or expense.

10 Claims, 6 Drawing Sheets

FUEL INJECTION SYSTEM FOR INTERNAL COMBUSTION ENGINES

BACKGROUND OF THE INVENTION

The invention is based on a fuel injection system for internal combustion engines as defined hereinafter. One such fuel injection system is already known from U.S. Pat. No. 4,964,389 or the corresponding German Patent Application A 38 43 467. There, via the electrically controlled valve in the fuel line leading away from the reservoir, a predetermined fuel injection quantity is metered into an intermediate reservoir, whose outlet can be connected to the distributor opening via a second electrically controlled valve. The fuel quantity delivered to the intermediate reservoir via the first electrically controlled valve, which is at the injection pressure made available by the high-pressure reservoir, is measured by the stroke of a reservoir piston that defines the intermediate reservoir and is determined in accordance with the length of time the first electrically controlled valve is opened, by means of a control unit. The first electrically controlled valve controls the quantity of fuel attaining injection. The second electrically controlled valve is opened at the desired injection time, and the fuel stored by the intermediate reservoir is fed to the particular injection nozzle.

The second electrically controlled valve then determines the injection time. This system is quite complicated, because it requires not only two electrically controlled valves but also a high-pressure intermediate reservoir.

OBJECT AND SUMMARY OF THE INVENTION

The fuel injection system according to the invention has the advantage over the prior art in that it is very simple in structure, with as few components as possible.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
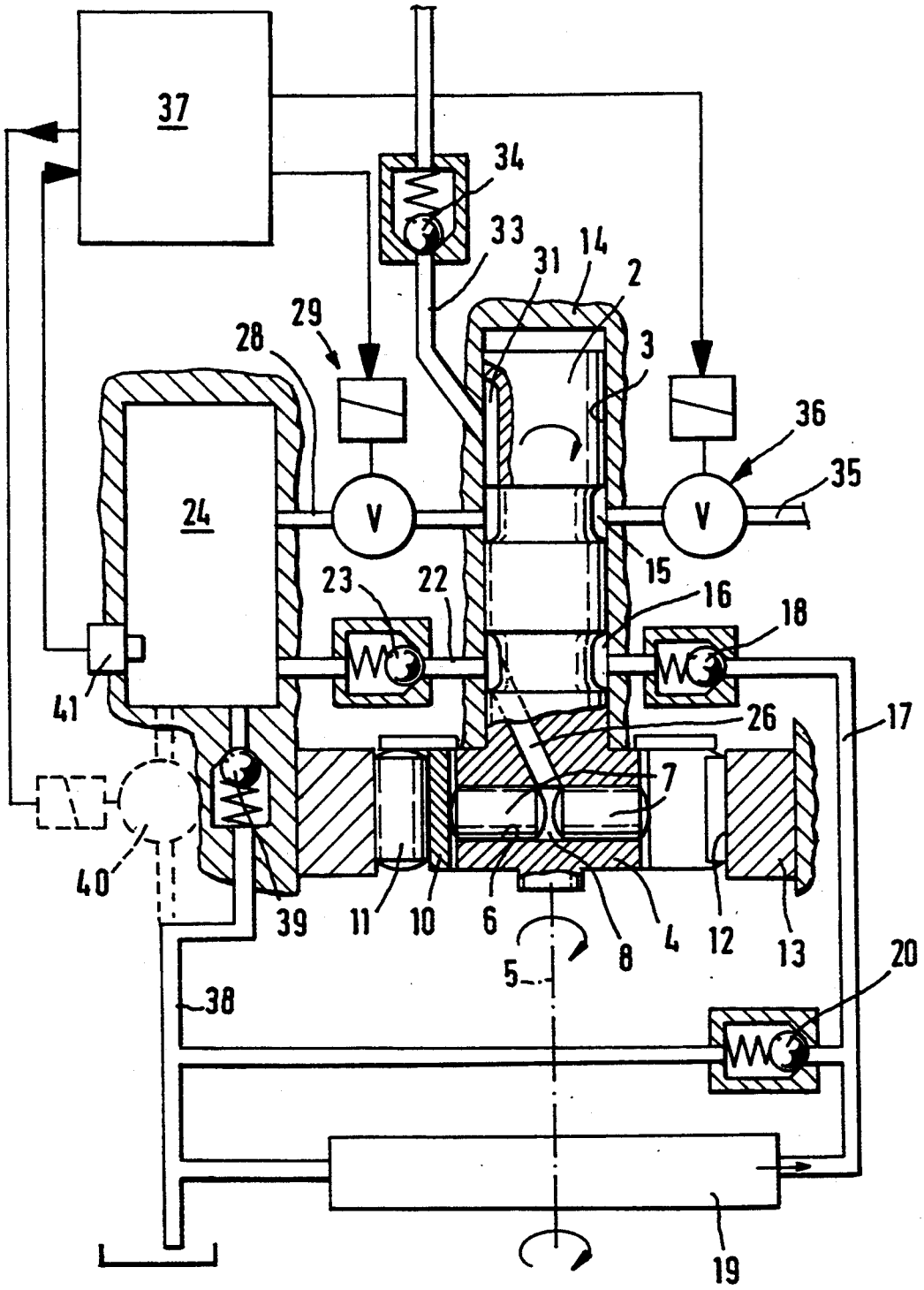
FIG. 1 shows a first exemplary embodiment with a radial piston distributor pump as a pressure generator and as a device for triggering a plurality of fuel injection valves, which are supplied with fuel from a high-pressure reservoir.

FIG. 1 is a partial section through portions of a high-pressure pump, of the radial piston distribution injection pump type. A distributor piston 2 is driven to rotate in a bore 3 by a drive mechanism, not shown in further detail. At the base 4 of the distributor, pump cylinders 6 located radially to its axis of rotation 5 are provided; in these cylinders, pump pistons 7 that are capable of reciprocating enclose a pump work chamber 8 between them. On their outer face end, the pump pistons contact roller shoes 10 with rollers 11, which roll along a cam path 12 of a cam ring 13 as the distributor piston rotates. The cam ring is supported in the housing 14 of the high-pressure fuel pump.

The distributor 2 has a first annular groove 15 and a second annular groove 16 spaced axially apart from the first annular groove. A fuel delivery line 17 discharges into this second annular groove 16, via a filling valve 18 in the form of a check valve, and is supplied with fuel by a fuel feed pump 19 driven in synchronism with the distributor 2; this fuel is kept at a certain supply pressure with the aid of a pressure control valve 20 that relieves the fuel delivery line 17 toward the intake side of the feed pump 19. Also leading from the second annular groove 16 is a pressure line 22, in which a feed valve 23 is disposed that is embodied as a check valve opening away from the annular groove 16. Via this feed valve 23, the pressure line 22 discharges into a high-pressure reservoir 24. Finally, the second annular groove communicates constantly with the pump work chamber 8 through a pressure line 26.

The high-pressure reservoir communicates with the first annular groove 15 via a fuel line 28, in which a first electrically controlled valve 29, in this case a magnet valve, is disposed. This annular groove communicates constantly with a distributor opening of the distributor 2 in the form of a distributor groove 31, which is machined into the jacket face of the distributor such that it extends parallel to the axis of rotation of the distributor, and which upon rotation of the distributor communicates in succession with injection lines 33 leading away from the bore 3. These injection lines 33 each communicate with one fuel injection valve of the engine, via a pressure valve 34 which may be embodied as a conventional pressure valve or as an equal-pressure or equal-volume valve, or as a return flow throttle.

Also branching off from the first annular groove 15 is a relief line 35, in which a second electrically controlled valve 36, in this case again a magnet valve, is disposed. Both magnet valves 29 and 36 are controlled by an electric control unit 37.

The high-pressure reservoir 24 finally also has a relief line 38, in which is disposed either a pressure holding valve 39 that functions mechanically and controls a certain pressure in the high-pressure reservoir 24, or an electrically controlled valve, in this case once again a magnet valve, which is controlled by the electric control unit 37 in accordance with signals of a pressure transducer 41, which detects the pressure in the high-pressure reservoir 24 and outputs signals accordingly to the electric control unit.

The fuel injection system described functions as follows: If the distributor piston is driven to rotate, which as a rule is done via the crankshaft of the associated engine in synchronism with the engine rpm, then the pump pistons are moved back and forth, following the cams of the cam path 12 over the roller shoes 10. Upon an outward motion, corresponding to an intake stroke, the pump pistons 7 then aspirate fuel via the filling valve 18. In the ensuing compression stroke, effected by the cams of the cam path, the pump pistons 7 positively displace fuel at high pressure via the feed valve 23 into the high-pressure reservoir, until a certain predetermined pressure has been attained there. This pressure may either be set by means of the pressure holding valve 39 or via the pressure transducer 41 in combination with the electric control unit 37 and the magnet valve 40. As long as the predetermined pressure in the reservoir 24 has not yet been attained, no outflow via the relief line 38 occurs. Once the set pressure has been exceeded, the pressure holding valve or the magnet valve opens in an analog or clocked fashion.

Once the certain pressure in the high-pressure reservoir is attained, fuel can be drawn from it for high-pressure injection in the engine. This takes place via the first electrically controlled valve 29, which is opened, under the control of the electric control unit, at a desired injection onset, whereupon the second electrically controlled valve 36 is closed. The fuel then flowing out of the high-pressure reservoir 24 reaches the corresponding fuel injection nozzle, via the distributor groove 31 and one of the injection lines 33, and then is injected. The quantity of fuel to be injected there is controlled by the second electrically controlled valve 36, in that this valve is opened once the fuel injection quantity is attained, so that the first relief groove 15 is relieved and the pressure in the injection line 33 or at the fuel injection valve drops below the injection pressure. Simultaneously with the opening of the second electrically controlled valve 36, the first electrically controlled valve 29 is closed. This closure of the first electrically controlled valve can also take place shortly before or shortly after the opening of the second electrically controlled valve 36. In the first case, there is a minimum loss of fuel put at high pressure from the reservoir 24. With the aid of the pressure valve 34, a pressure that remains constant is typically adhered to in the injection line between the injection valve and the pressure valve in the intervals between the high-pressure injection events, if this pressure valve is embodied as an equal-pressure valve. The option also exists, however, of relieving the various injection lines to a predetermined pressure level once injection has taken place, by means of an arrangement of control grooves on the distributor piston.

By the disposition of these two electrically controlled valves, an exact fuel injection onset and an exact end of injection for the various injection events can be attained by a clocked triggering of these valves; even the slightest fuel injection quantities can still be controlled precisely. A preinjection before the main injection is also attainable. This proves to be advantageous especially in conjunction with the high-pressure reservoir which is put at a constant pressure, since then over the entire operating range of the associated engine, constant conditions in terms of the existing injection pressure and pressure drops prevail. Deviations in fuel injection quantities, which ensue particularly from an rpm dependency, are thus kept very slight. Optionally, however, throttling in the case of brief injection times or high rpm may be compensated for by suitable adaptation of the pressure in the high-pressure reservoir.

Since the injection valves each become involved in the control of the injection operation by only one edge subsequent to the opening or closing motion, the outcome of control is not as strongly dependent on the speed of the valves in either their opening or their closing operation. In particular, high-speed controlling motions of the valves can be attained in this way without major effort. In the system proposed, advantages are also attained because the design of the cams of the cam path no longer needs to be adapted to the special conditions prevailing during the time of injection. The cam drives serve merely to furnish the high injection pressure. To attain an especially constant injection pressure, it is advantageous to provide a plurality of pump pistons or a plurality of pump piston supply strokes per revolution of the distributor. The supply strokes of the pump pistons may be within the segments of time with which the fuel injection valves are also supplied with high-pressure fuel for injection from the high-pressure reservoir 24, or outside those time segments.

Controlling the reservoir pressure may be done as described via an outflow control, or via controlling a supply quantity of the high-pressure pump, which would have the advantage of a lower drive capacity but would entail somewhat greater effort and expense.

Figure 2:
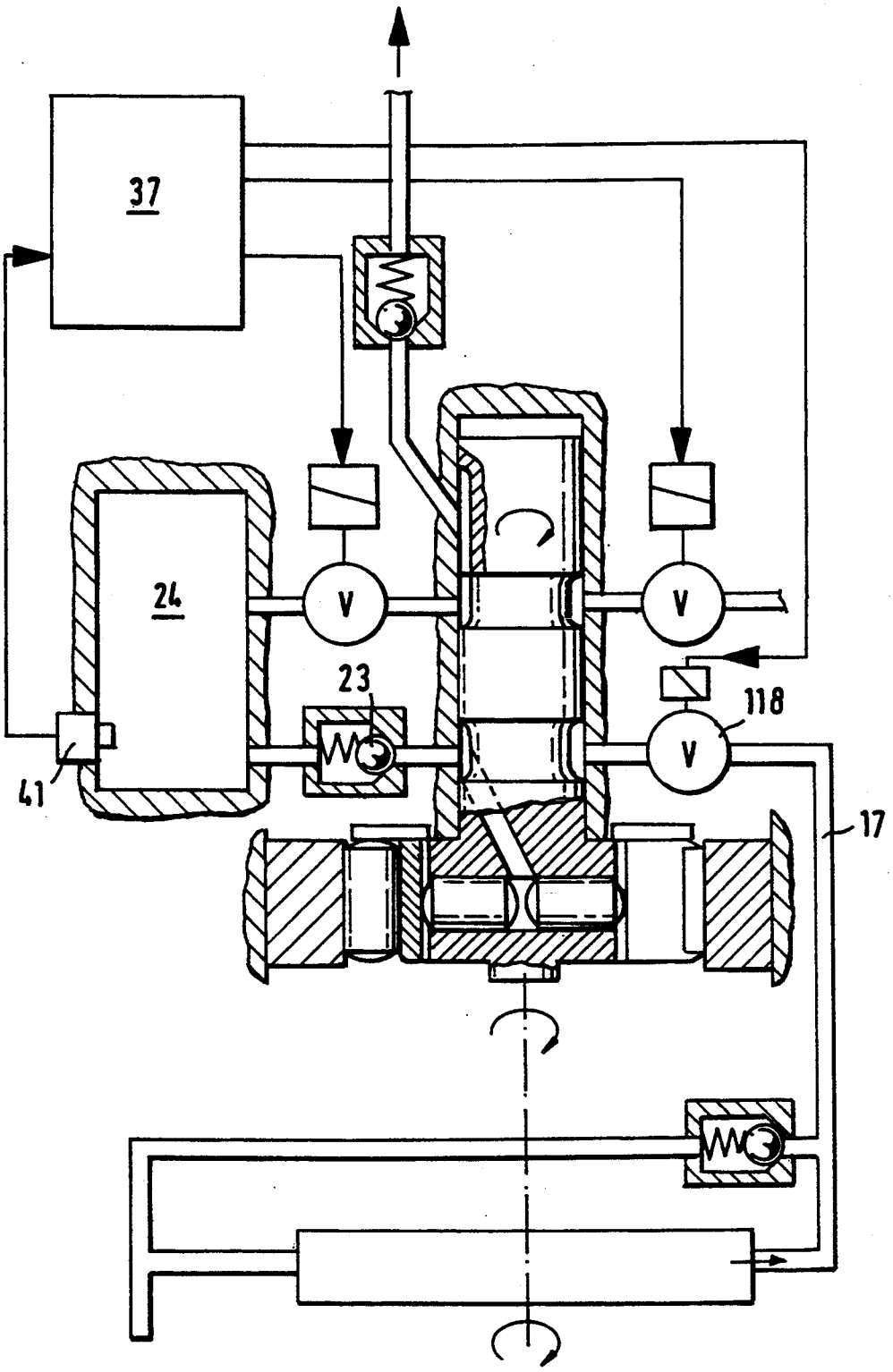
FIG. 2 shows a second exemplary embodiment, as a modification of FIG. 1 with a controlled high-pressure supply quantity of the pressure generator.

FIG. 2 shows an exemplary embodiment as a further feature of the exemplary embodiment of FIG. 1, in which this kind of control of the supply quantity of the high-pressure pump is performed. Unlike the exemplary embodiment of FIG. 1, in this case a magnet valve 118, which is triggered by the control unit 37, is provided in the fuel delivery line 17 instead of the check valve 18. With the aid of this magnet valve, as a function of the pressure coming to be established in the high-pressure reservoir 24, which is detected by the pressure transducer 41, either the intake quantity in the intake stroke of the pump pistons, or the high-pressure supply phase of the pump pistons can be controlled. In the first case, the pump work chamber 8 is supplied with fuel in the intake stroke in accordance with the rate of opening of the magnet valve 118, and this fuel introduced into the pump work chamber is then brought to high pressure in the supply stroke of the pump pistons and transferred to the high-pressure reservoir via the feed valve 23. In the second case, the pump work chamber is constantly fully filled in the intake stroke of the pump piston when the magnet valve 118 is open, and this magnet valve is then closed for a certain duration of the ensuing compression stroke of the pump pistons 7, so that fuel is brought to high pressure in the pump work chamber. After and before the opening of the magnet valve 118, the fuel merely escapes back into the fuel delivery line 17 in the compression stroke of the pump pistons. In such a case, the magnet valve 40, which in the version of FIG. 1 serves to control pressure in the high-pressure reservoir 24 and is shown in dashed lines in FIG. 1, or the pressure holding valve 39 provided as a substitute, becomes unnecessary. This arrangement simplifies the system.

The design of the supply capacity of the high-pressure pump advantageously offers the possibility here of generating a high injection pressure in the reservoir 24 even at a low rpm; then the reservoir is correspondingly relieved at higher rpm, when an optionally possible adaptation of the reservoir pressure to the rpm is done.

The fuel injection system described is distinguished above all by simple components, with universal control possibilities for the injection onset and injection quantity.

Figure 3:
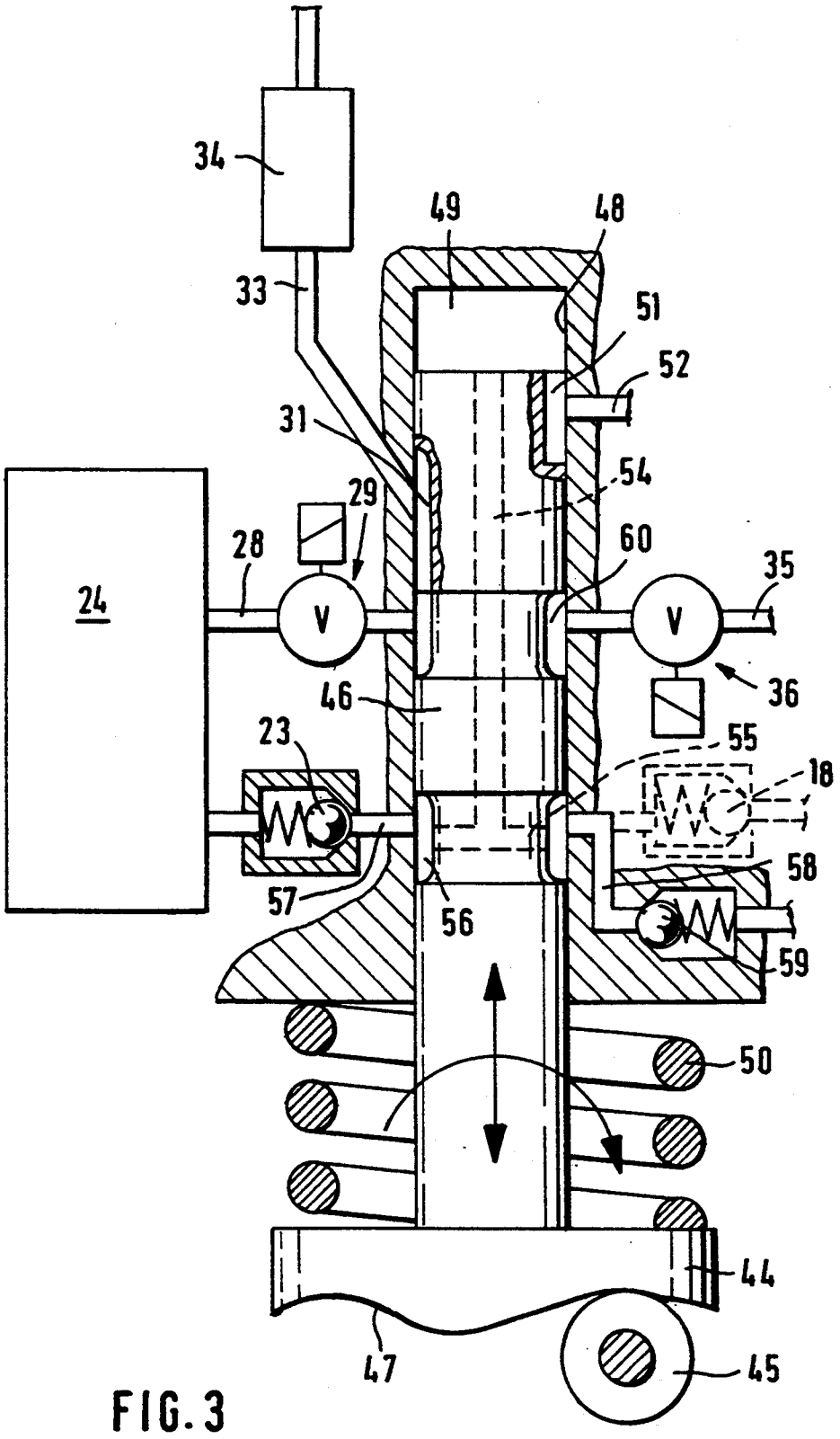
FIG. 3 shows a third exemplary embodiment with a modified version of a pressure control unit for the high-pressure reservoir in the first exemplary embodiment.

Instead of the radial piston pump described as a generator for the high injection pressure, a pump of the axial piston type may also be used, as shown in FIG. 3. Such a pump has a rotationally driven end cam disk 44, which rolls on stationary-supported rollers, only one of which is shown. Connected to the end cam disk is a pumping and distributor piston 46, which is not only carried along in rotation by the end cam disk 44 but also moves axially back and forth in a pump cylinder 48 as the cam path 47 of the end cam disk moves over the rollers 45; in the cylinder 48, the pumping and distributor piston 46 encloses a pump work chamber 49 on the end.

The end cam disk is held in contact with the rollers 45 in its rotation by means of a strong restoring spring 50, so that the pump piston 46 reliably executes its intake stroke. By means of the end cam disk, the pump piston is set into a plurality of reciprocating intake and supply strokes, communicating with the pump work chamber 49, in the course of one complete revolution. In its intake stroke, it aspirates fuel via a filling valve in the form of an intake groove 51 in its jacket face that communicates with the pump work chamber 49 and via a fuel delivery line 52 that discharges into the pump cylinder 48. As the supply stroke begins, the control edges that define the intake groove close off the mouth of the fuel delivery line 52, and the fuel located in the pump work chamber 49 is compressed and carried via an axial blind bore 54, which begins at the face end of the pump piston 46, and via a transverse bore 55 into an annular groove 56, in the surface of the region of the pump piston guided in the pump cylinder 48. This annular groove 56 communicates continuously with a pressure line 57, which corresponds to the pressure line 22 and discharges into the high-pressure reservoir 24 and likewise includes a feed valve 23. The annular groove 56 also communicates continuously with a relief line 58, in which a pressure holding valve 59 is disposed that opens toward the relief side.

In this exemplary embodiment, besides the second annular groove 56 already mentioned, there is a first annular groove 60 in the jacket face of the pump piston 46, corresponding to the first annular groove 15 or the second annular groove 16 of the exemplary embodiment of FIG. 1.

This first annular groove 60 again communicates with the high-pressure reservoir 24 via a fuel line 28 and includes the first electrically controlled valve 29. The relief line 35 having the second electrically controlled valve 36 again branches off from the first annular groove 60. Finally, the distributor groove 31 also communicates with the first annular groove 60; by way of this distributor groove, one of the injection lines 33 is triggered at a time in the supply stroke in the course of the rotation of the pumping and distributor piston 46, and this line again includes a pressure valve and leads to the particular injection valve at the fuel injection pump. To this extent, with respect to the first annular groove 60, this exemplary embodiment is identical in design to the exemplary embodiment of FIG. 1; the width of the annular groove in the axial direction of the pump piston 46 and the length of the distributor groove must take into account the pumping reciprocating motions of the motion 46. The triggering of the magnet valves 29 and 36 takes place in the same way as in the exemplary embodiment of FIG. 1, and the intended pumping strokes of the pump piston may also be designed in accordance with the description of FIG. 1. A deviating feature in this exemplary embodiment is that a filling valve in the form of a check valve 18 is omitted; it is shown in dashed lines in the drawing anyway, but instead, groove control with the aid of the intake groove 51 is provided. In this kind of control, either intake grooves may be provided, corresponding in number to the number of the intake strokes of the pump piston per revolution, with a single fuel delivery line 52, or a plurality of fuel delivery lines may be provided, or only one intake groove may be provided and in that case the intake lines are distributed over the circumference of the pump cylinder 48, corresponding in number to the number of intake strokes of the pump piston. With respect to the service life, this kind of control of the intake stroke with the aid of a control edge has advantages over a filling valve embodied as a check valve. Naturally, it may also be used analogously to the exemplary embodiment of FIG. 1. Deviating from the exemplary embodiment of FIG. 1, but a feature that may also be provided there, is the fact that the pressure holding valve 39, now in the form of the pressure holding valve 59, is located upstream of the feed valve 23, so that an excessive pressure rise can quickly be reduced again. The pressure holding valve 59, here embodied as a check valve, may naturally also be a magnet valve controlled by a pressure sensor, analogous to the exemplary embodiment of FIG. 1.

Figure 4:
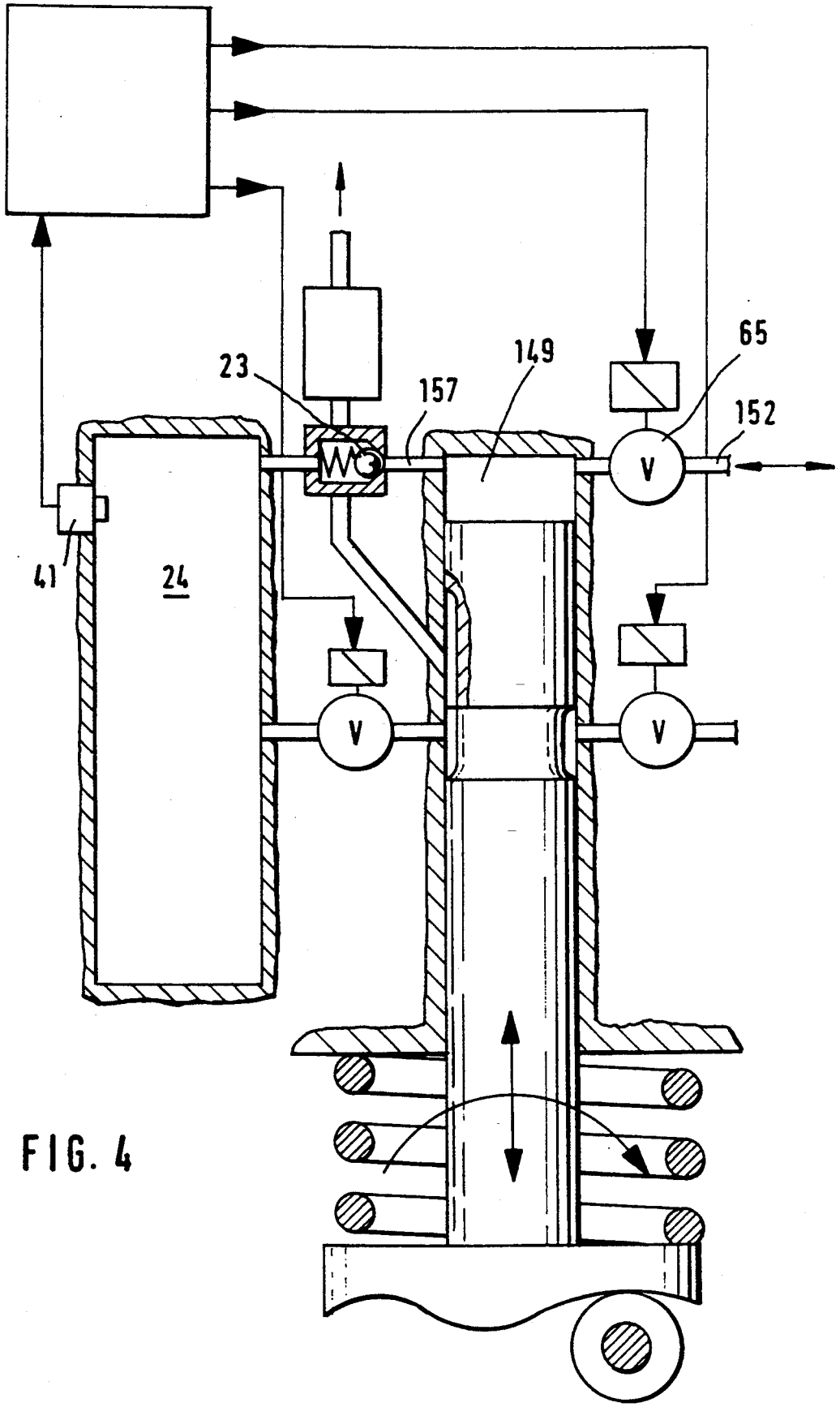
FIG. 4 shows a fourth exemplary embodiment as a modification of the exemplary embodiment of FIG. 3 with a controlled high-pressure supply quantity.

As already explained for FIG. 2, filling of the pump work chamber can also be done in a fuel pump of the type shown in FIG. 4 via a magnet valve 65, which is disposed in a fuel delivery line 152 discharging directly into the pump work chamber 49, as FIG. 4 shows. In this case, the second annular groove 56 of the exemplary embodiment of FIG. 3 is omitted. Instead, the pump work chamber 49 communicates likewise directly with the pressure reservoir 24 via a pressure line 157 that also contains the feed valve 23. With the omission of the second annular groove 56, the pressure holding valve 59 in the line 58 of FIG. 3 is also absent, and because of the direct connection of the pressure line 157 and the fuel delivery line 152, the axial blind bore 54 and the transverse bore 55 in the piston 46 are also omitted. With respect to controlling the fuel injection quantity, the exemplary embodiment of FIG. 4 functions in the same way as that of FIG. 3. The only difference is that regulation of the pressure in the high-pressure reservoir 24 can now be carried out by the magnet valve 65. Analogously to the exemplary embodiment of FIG. 2, this valve is controlled by the electric control unit 37, which finds out the actual value of the reservoir pressure via the pressure transducer 41. With the aid of the magnet valve 65, filling of the pump work chamber 49 can now again be done in controlled fashion, in such a way that this chamber receives only the fuel quantity that in its supply stroke it transfers at high pressure to the high-pressure reservoir 24, or else a pump work chamber is completely filled with fuel upon each intake stroke of the pump piston 46, and with the aid of the electrically controlled magnet valve 65 the effective high-pressure supply stroke of the pump piston is determined, so that the desired pressure in the high-pressure reservoir is attained. Then as in FIG. 2 as well, the fuel delivery line 152 serves to fill the pump work chamber and also to relieve it during portions of a supply stroke.

Although the pressure generation was done here with the aid of pumps in accordance with the design of typical distributor pump types, where these pumps perform not only pressure generation for the high-pressure reservoir but also the distributor function, it is also possible to provide a high-pressure pump and a separate distributor in a known manner. In principle, the generation of high pressure is independent of the distributor function. However, a very compact component is attained if the pump of the distributor pump type is used as a pressure generator.

Figure 5:
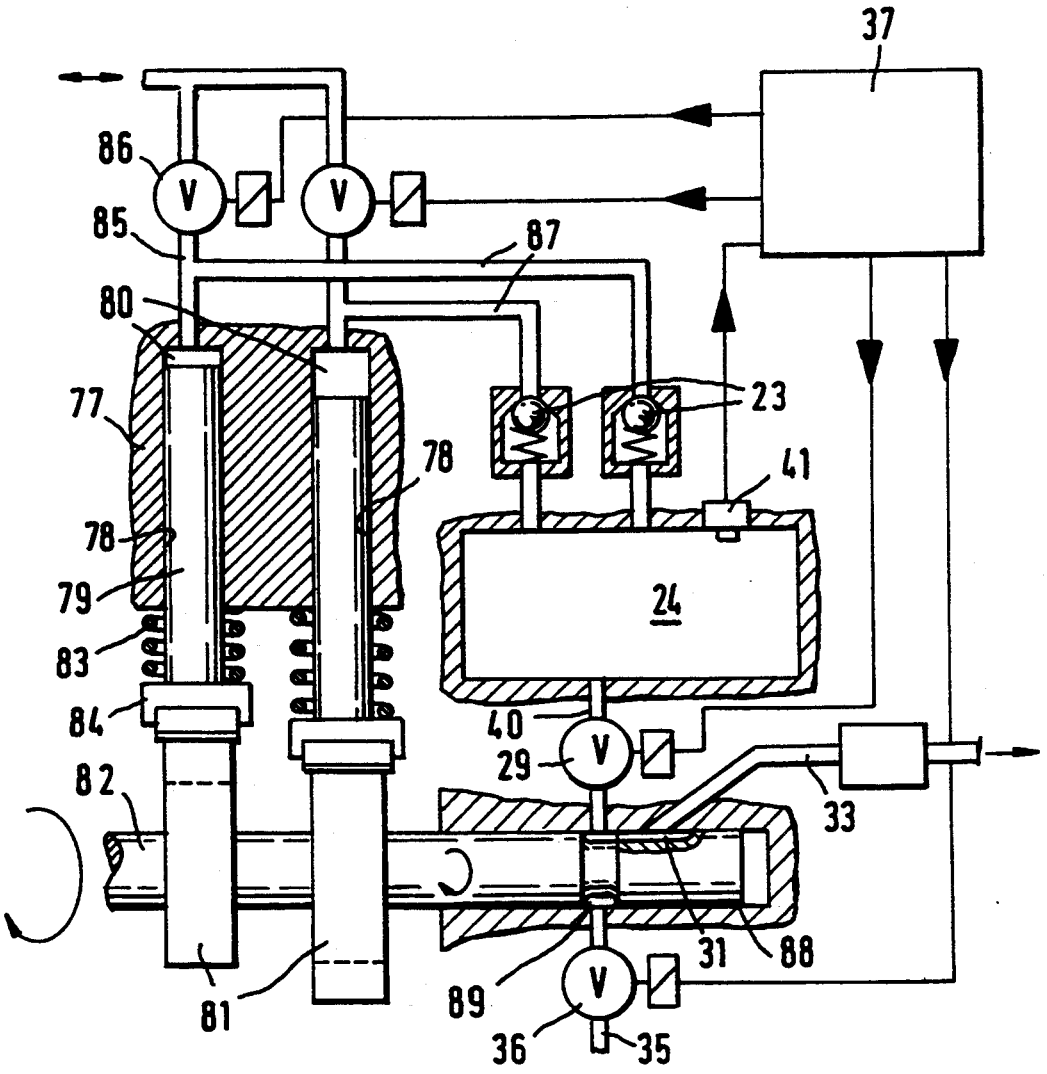
FIG. 5 shows a fifth exemplary embodiment, based on an in-line fuel injection pump.

An example for a fuel injection pump of the in-line pump type with a separately provided distributor, FIG. 5 shows a pump in which a plurality of pump cylinders 78 are provided located next to one another in a pump housing 7; in the cylinder, pump pistons 79 are fitted tightly and with their face ends enclose pump work chambers 80 in the pump cylinders 78. The pump pistons are driven to reciprocate by cams 81 of a camshaft 82 and thus execute compression strokes and intake strokes. The pump pistons are held on the cam path of the cams 81 by compression springs 83 via roller shoulders 84, and the pump pistons execute their intake strokes under the influence of the compression springs.

Fuel delivery lines 85 discharge into the pump work chamber, and in each of these lines there is one magnet valve 86 as a filling valve. The fuel delivery line communicates with a fuel source. One pressure line 87 each branches off between the pump work chamber 80 of the magnet valve 86, and in each pressure line there is again a feed valve 23, via which the pump work chambers 80 are made to communicate with a common high-pressure reservoir 24. As in the preceding exemplary embodiment, this reservoir has the pressure sensor 41, which is connected to the control unit 37, which in turn also triggers the magnet valves 86, analogous to the triggering of the magnet valves 65 of FIG. 4 and 118 of FIG. 2.

One end of the camshaft is embodied as a distributor and travels in a cylinder bore 88 in the housing 77. There, the camshaft has an annular groove 89, corresponding to the first annular groove 15 of FIG. 1 or 60 of FIG. 3, into which annular groove a fuel line 90, corresponding to the fuel line 28, discharges from the pressure reservoir 24. The magnet valve 29, already known from the above exemplary embodiments, is again inserted into this fuel line 90. Once again, the relief line 35, which contains the magnet valve 36, branches off from the annular groove 89. The distributor groove 31 again communicates continuously with the annular groove 89, and depending on the rotary position of the camshaft now opens one of the plurality of injection lines 33 distributed over the circumference of the cylinder bore 88.

This pump shown in FIG. 5 functions in principle the same way as the exemplary embodiments described above, as far as the control and distribution of the fuel injection quantity with the aid of the magnet valves 29 and 36, and the control of the high-pressure 24 with the aid of the magnet valves 86, are concerned. Unlike the above exemplary embodiments, here there are merely a plurality of pump pistons disposed in a line with each other and a distributor separate from the pump pistons.

One advantage of the above fuel injection system for internal combustion engines is that as a result of the control by means of magnet valves, particularly as in the exemplary embodiments of FIGS. 2, 4 and 5, a superposition of pressure waves can be attained at higher rpm in the line between the pump and the injection valve, which leads to a known phenomena of pressure exaggeration at the moment of injection, compared with the starting pressure in the high-pressure reservoir 24. With a reservoir pressure of 1200 bar, for instance, an injection pressure of bore than 1500 bar can then be attained at the injection valve, at rated rpm.

Figure 6:
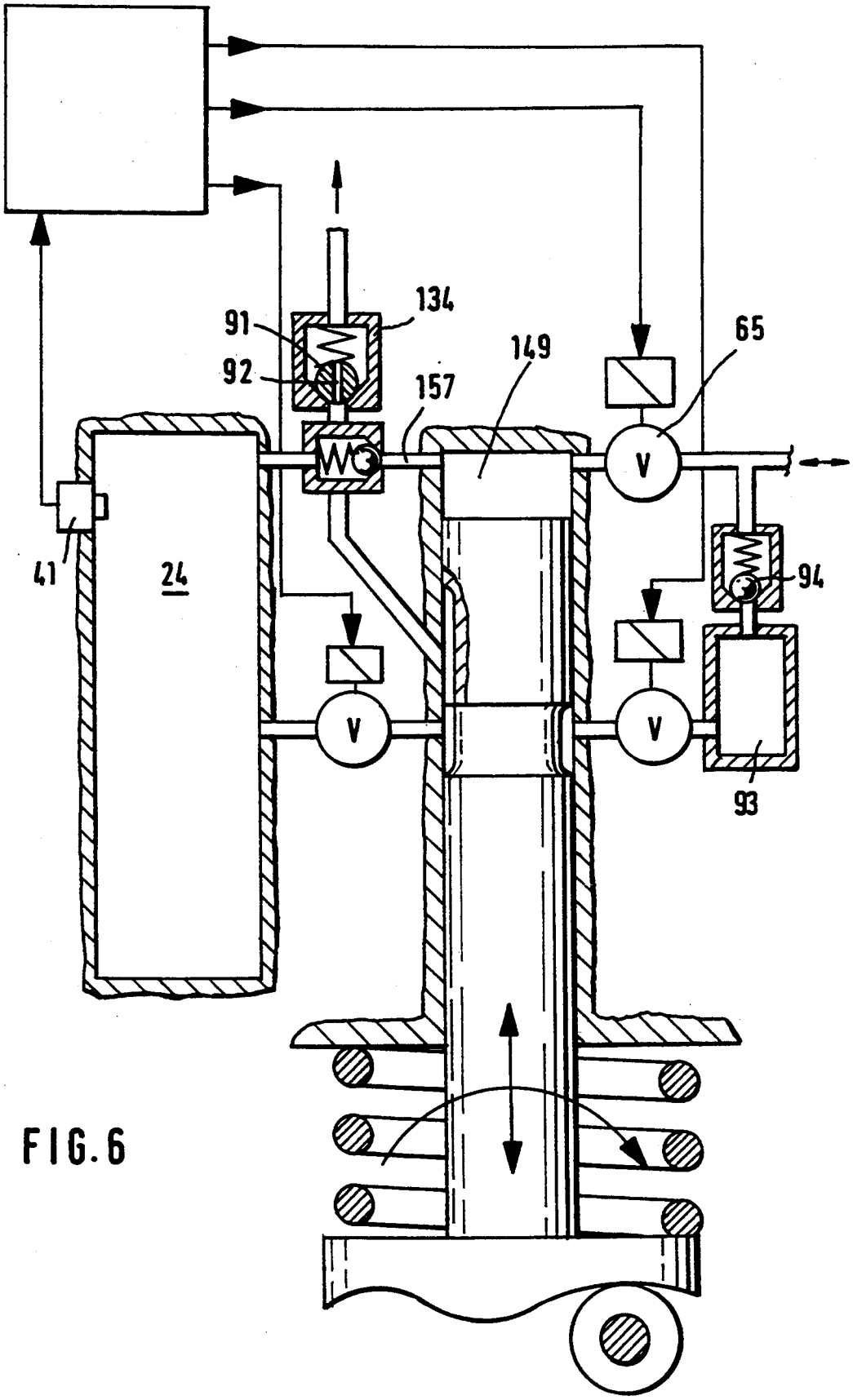
FIG. 6 shows a sixth exemplary embodiment which is a modification of the exemplary embodiment of FIG. 4.

The above-described fuel injection system has the advantage over the conventionally magnet-valve-controlled injection pumps of separate relief of the injection line downstream of the first controlled valve 29 by the second controlled valve 36. While in the conventional systems the pump work chamber is both filled and relieved via a magnet valve, in the present case the relief takes place via a separate relief line 17 in FIG. 1, or 35 in FIG. 3. Such systems require an equal-pressure valve, in order to maintain a certain desired holding pressure in the injection line after the termination of injection by the injection valve. This pressure is necessary so that in the ensuing injection events different volumes will not have to be filled until the opening pressure of the injection valve is attained, which volumes would be present if different pressures were to prevail in the intervals between injections in the injection line. On the other hand, even now, it is still necessary for pressure waves, which are known to occur in the closing process of the injection valve, to be reduced. With the embodiment of FIG. 6, a simplified design of a pressure valve is now obtained with a supplementary feature on the relief side. As a feature modified from the exemplary embodiment of FIG. 4, the exemplary embodiment of FIG. 6 now shows a pressure valve 134, which in a schematic design is embodied in substitute fashion as a ball-type check valve.

Naturally, other conventional closing members 91 may also be provided here. Also merely shown symbolically, a throttle 92 is provided, which in the closing state of the pressure valve 134, or in other words when the closing element 91 is tightly on its seat, maintains a throttle restriction of predetermined size. This throttle restriction may extend within the closing element or be provided in a bypass around this closing element. Via this throttle, after the termination of high-pressure fuel supply to the injection valve, any pressure peak that then arrives there of the pressure waves moving back and forth in the injection line is reduced, or relieved toward the relief line 35. In order that this pressure will now not be arbitrarily reduced, the relief line 35 discharges into a relief chamber 93, which is kept at a certain pressure, such as 100 bar. This is done with the aid of a pressure holding valve 94, by way of which the relief chamber 93 is now finally relieved to a chamber of lower pressure, of the kind that the fuel source for filling the pump work chamber makes available. With this design, a certain residual pressure can be maintained in all the injection lines, via the pressure holding valve that is now assigned to all the injection valves in common. Thus the expenditure for setting the pressure in the injection lines is less compared with known fuel injection systems. The pressure valve 134 can in each case simply have merely a throttle bore in its closing element.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection system for internal combustion engines, having a high-pressure pump, which aspirates fuel via a filling valve (18; 51, 52) into a pump work chamber (8, 49) defined by a pump piston (7, 46, 79) and feeds the fuel at high pressure via a feed valve (23) into a high-pressure reservoir (24), whose pressure is held at a certain value via a pressure control unit (39, 59; 40, 41, 37); said pressure control unit has a filling valve (118, 65, 86), electrically controlled by the control unit (37), said filling valve is disposed in a fuel delivery line (17, 152, 85) and has opening and closing times which are controlled as a function of pressure in the high-pressure reservoir (24) in order to control the high-pressure supply quantity of the pump piston (7, 46, 79) of the high-pressure pump, a distributor (2, 46) is driven in synchronism with the engine, and upon its rotation successively supplies fuel via a distributor opening (31) to injection lines (33) leading to various injection valves of the engine; a first valve (29) is located in a fuel line (28, 15, 60, 33) leading from the high-pressure reservoir (24) to the distributor opening (31) and is electrically controlled by a control unit (37), a second electrically controlled valve (36) is provided downstream of the first electrically controlled valve (29) in a relief line (35) that communicates with the distributor opening (31), and that for controlling the instant of injection and the injection quantity by opening of the first electrically controlled valve (29) while the second electrically controlled valve (36) is closed, the injection onset is determined, and by opening the second electrically controlled valve (36), the injection end is determined.

2. A fuel injection system as defined by claim 1, in which the first electrically controlled valve (29) is triggered for its closing operation simultaneously with the opening of the second electrically controlled valve (36).

3. A fuel injection system as defined by claim 1, in which the first electrically controlled valve (29) is closed before or after the opening of the second electrically controlled valve (36).

4. A fuel injection system as defined by claim 1, in which the pressure control unit has a relief line (38, 58) which contains a valve (39, 40, 59) and which can be made to communicate upstream of the feed valve with the pump work chamber.

5. A fuel injection system as defined by claim 1, in which the fuel delivery line (17, 152, 85) discharges directly into the pump work chamber (48, 80), which communicates directly with the feed valve 23.

6. A fuel injection system as defined by claim 1, in which one pressure valve (134) is disposed in each of the injection lines (33) and has a closing element (91) that opens counter to a spring force when fuel is fed to the injection valve and has a constantly open throttle restriction (92), and that downstream of the second electrically controlled valve (36), the relief line (35) discharges into a relief chamber (93), which can be relieved to a chamber of lower pressure via a pressure holding valve (94).

7. A fuel injection system as defined by claim 5, in which the first electrically controlled valve (29) is triggered for its closing operation simultaneously with the opening of the second electrically controlled valve (36).

8. A fuel injection system as defined by claim 5, in which the first electrically controlled valve (29) is closed before or after the opening of the second electrically controlled valve (36).

9. A fuel injection system as defined by claim 5, in which the pressure control unit has a relief line (38, 58) which contains a valve (39, 40, 59) and which can be made to communicate upstream of the feed valve with the pump work chamber.

10. A fuel injection system as defined by claim 5, in which one pressure valve (134) is disposed in each of the injection lines (33) and has a closing element (91) that opens counter to a spring force when fuel is fed to the injection valve and has a constantly open throttle restriction (92), and that downstream of the second electrically controlled valve (36), the relief line (35) discharges into a relief chamber (93), which can be relieved to a chamber of lower pressure via a pressure holding valve (94).

* * * * *